United States Patent [19]

Kishimoto et al.

[11] Patent Number: 4,762,774

[45] Date of Patent: Aug. 9, 1988

[54] METHOD FOR COLOR IMAGE FORMATION COMPRISING A RAPID DESILVERING PROCESS

[75] Inventors: Shinzo Kishimoto; Toshihiro Nishikawa; Akira Abe; Junya Nakajima, all of Kanagawa, Japan

[73] Assignee: Fuji Photo Film Co., Ltd., Kanagawa, Japan

[21] Appl. No.: 920,138

[22] Filed: Oct. 17, 1986

[30] Foreign Application Priority Data

Oct. 19, 1985 [JP] Japan ..... 60-233995

[51] Int. Cl.[4] ..... G03C 7/02; G03C 5/44; G03C 5/38; G03C 1/06

[52] U.S. Cl. ..... 430/393; 430/430; 430/460; 430/461; 430/566; 430/567; 430/611

[58] Field of Search ..... 430/393, 430, 460, 567, 430/461, 611, 566

[56] References Cited

U.S. PATENT DOCUMENTS

| | | | |
|---|---|---|---|
| 4,429,031 | 1/1984 | Tsuboto et al. | 430/218 |
| 4,458,010 | 7/1984 | Yamamuro et al. | 430/393 |
| 4,578,345 | 3/1986 | Ohno et al. | 430/393 |
| 4,666,825 | 5/1987 | Shimba et al. | 430/393 X |

*Primary Examiner*—Mukund J. Shah

*Attorney, Agent, or Firm*—Birch, Stewart, Kolasch & Birch

[57] ABSTRACT

A method for color image formation is disclosed, comprising imagewise exposing to light a silver halide color photographic material having a silver halide emulsion layer containing monodispersed silver halide grains, subjecting the exposed material to color development, and processing the material with a bath primarily having bleaching capacity and then with a bath having bleach-fixing capacity. The method realizes acceleration of desilvering to reduce the processing time.

19 Claims, No Drawings

METHOD FOR COLOR IMAGE FORMATION COMPRISING A RAPID DESILVERING PROCESS

FIELD OF THE INVENTION

This invention relates to a method for color image formation using a silver halide color photographic material and, more particularly, to a method for color image formation which can realize rapid desilvering processing.

BACKGROUND OF THE INVENTION

In general, basic processing steps of color light-sensitive materials include color development processing and desilvering processing. In the color development processing step, an exposed silver halide is reduced by a color developing agent to form silver and, at the same time, the oxidized color developing agent reacts with a color former (coupler) to provide a dye image. In the subsequent desilvering processing step, the silver formed by the development is oxidized with a bleaching agent and then converted to a soluble silver complex by the action of a fixing agent, which is then dissolved and removed.

In order to maintain photographic or physical qualities of an image or improve preservative property of an image, development processing further includes, in addition to the above-described basic steps, various auxiliary steps, such as hardening, stopping, image stabilization, washing, and the like.

In recent years, rapid processing, i.e., reduction of the time required for processing has been highly demanded. Reduction in the time for desilvering that occupies nearly half of the overall processing has been a particularly great subject of study.

One conventionally known means for achieving rapid desilvering is a bleach-fix bath containing both an aminopolycarboxylic acid iron (II) complex and a thiosulfate as disclosed in German Pat. No. 866,605. According to this technique, however, since an aminopolycarboxylic acid iron (II) complex having a weak oxidative effect (bleaching power) by nature is copresent with a thiosulfate having a reducing power, the bleaching power of the complex becomes too weak to effect sufficient desilvering for photographic color light-sensitive materials of high sensitivity and of high silver content. On the other hand, it has been proposed to enhance the bleaching power by adding various bleach accelerators to a bleaching bath or a bleach-fix bath. Examples of such bleach accelerators include various mercapto compounds as described in U.S. Pat. No. 3,893,858, British Pat. No. 138842 and Japanese Patent Application (OPI) No. 141623/78 (the term "OPI" herein used means a "published unexamined Japanese patent application"), compounds having a disulfide linkage as described in Japanese Patent Application (OPI) No. 95630/78, thiazolidine derivatives as described in Japanese Patent Publication No. 9854/78, isothiourea derivatives as described in U.S. Pat. No. 4,144,068, thiourea derivatives as described in U.S. Pat. Nos. 3,617,283 and 3,809,563, thioamide compounds as described in Japanese Patent Application (OPI) No. 42349/74 and dithiocarbamic acid salts as described in Japanese Patent Application (OPI) No. 26506/80.

Nevertheless, incorporation of these bleach accelerators into a bleaching bath, a bleach-fix bath or a prebath therefor is still insufficient for establishment of rapid processing, and further improvements have been demanded.

SUMMARY OF THE INVENTION

Accordingly, an object of this invention is to provide a method for processing by which desilvering of a color light-sensitive material can be accelerated to reduce the processing time.

Another object of this invention is to provide a color light-sensitive material which is particularly suitable for reduction of processing time.

A further object of this invention is to provide a method of image formation which can obtain a high quality image through rapid processing by combining a specific color light-sensitive material and a specific method for processing.

As a result of extensive investigations, it has now been found effective to accomplish the above-described objects by subjecting a color light-sensitive material, after color development, to bleaching followed by processing with a bath having bleach-fixing ability. As a result of further investigations, it has also been found that markedly improved results can be obtained by using a silver halide color photographic material having a silver halide emulsion layer containing mono-dispersed silver halide grains as compared with a silver halide color photographic material having a poly-dispersed emulsion layer. The present invention has been completed based on these findings.

That is, the present invention relates to a method for color image formation comprising imagewise exposing a silver halide color photographic material having a silver halide emulsion layer containing mono-dispersed silver halide grains to light, subjecting the exposed material to color development, and processing the material with a bath chiefly having bleaching ability and then with a bath having bleach-fixing ability.

DETAILED DESCRIPTION OF THE INVENTION

The term "mono-dispersed emulsion" as herein used means an emulsion wherein silver halide grains have grain size distribution having a coefficient of variation ($S/\bar{r}$) of not more than 0.25, wherein $\bar{r}$ represents a mean grain size, and S represents a standard deviation with respect to grain size. More specifically, when individual grains have a grain size ri, and the number of grains is ni, $\bar{r}$ and S are defined by the following equations:

$$\bar{r} = \frac{\Sigma ni \cdot ri}{\Sigma ni}$$

$$S = \sqrt{\frac{\Sigma (\bar{r} - ri)^2 \cdot ni}{\Sigma ni}}$$

The term "individual grain size" as herein used means a diameter of the project area obtained by photographing a silver halide emulsion by a method well-known in the art (usually electron microscope photography) as described in T. H. James, *The Theory of the Photographic Process,* 3rd Ed., p. 36–43 (1966). The diameter of the project area is a diameter of a circle having the same area as the projected area as described in the above-cited publication. Therefore, it is possible to obtain a mean grain size $\bar{r}$ and its deviation S according to the above definitions even if silver halide grains have a shape other than a sphere, such as a cube, an octahedron, a tetradecahedron, a tabular shape, pebble-like shape, etc.

In the present invention, a coefficient of variation in grain size of the silver halide grains is not more than 0.25, preferably not more than 0.20, and more preferably not more than 0.15.

The size of the silver halide grains is not particularly limited, but is preferably from 0.4 to 5 μm, more preferably from 0.6 to 3 μm, and most preferably from 1.0 to 2.5 μm.

The silver halide grains may have a regular crystal form, such as a hexahedron, an octahedron, a dodecahedron, a tetradecahedron, etc., or an irregular crystal form, such as a sphere, a tabular shape a pebble-like shape, etc. Normal crystal grains having a regular crystal form are particularly preferred.

In the case of normal crystal grains, those having 50% or more of a (111) face are preferred. In the case of grains having an irregular crystal form, those having 50% or more of a (111) face are also preferred. The facial proportion of a (111) face can be determined by a Kubelka Munk's dye adsorption method. In this method, a dye is chosen which preferentially adsorbs onto either one of a (111) face and a (100) face in such a manner that the association of the dye on the face (111) spectroscopically differs from that on the face (100), and such a dye is added to an emulsion. The proportion of the face (111) can be decided by close examination of a spectrum in relation to the amount of the dye added. The details for the above-described dye adsorption method are described in T. Tani, *Nihon Kagakushi,* p. 942(1984).

The silver halide grains preferably contain not less than 60 mol% of silver bromide and not more than 10 mol% of silver chloride, more preferably from 2 to 40 mol% of silver iodide, and most preferably from 5 to 20 mol% of silver iodide. The halogen composition distribution among grains is preferably narrow.

In the most preferred embodiment, the mono-dispersed emulsion grains which can be used in the present invention have a layered structure composed of substantially two distinct stratifom structures, one of which is a high iodide layer as a core and the other being a low iodide layer as an outer shell. Grains having such a layered structure will be described below in detail.

The core comprises silver halides of a high iodide content, preferably in the range of from 10 mol% to 45 mol% that is a solid solubility limit, more preferably from 10 to 45 mol%, and most preferably from 15 to 40 mol%. Silver halides other than silver iodide in the core may be either silver chlorobromide or silver bromide, but a higher proportion of silver bromide is preferred.

The outer shell comprises silver halides containing not more than 5 mol% of silver iodide, and preferably not more than 2 mol%. Silver halides other than silver iodide in the outer shell may be any of silver chloride, silver chlorobromide and silver bromide, with a high proportion of silver bromide being preferred.

The above-described distinct stratiform structure can be analyzed by X-ray diffractometry. Application of X-ray diffractometry to silver halide grains is described in H. Hirsch, *Journal of Photographic Science,* Vol. 10, p. 129 and after (1962). Once a lattice constant is decided by a halogen composition, diffraction peaks appear at an angle of diffraction that satisfies a Bragg's condition ($2d \cdot \sin\theta = n\lambda$).

Details for X-ray diffractometry are described, e.g., in Kisobunsekikagaku Koza 24, *X-Sen Bunseki,* Kyoritsu Shuppan, *X-Sen Kaiseki no Tebiki,* Rikagaku Denki K.K., etc. The standard method of analysis comprises obtaining a diffraction curve of a (220) face of silver halides using Cu as a target and Kβ rays of Cu as a ray source (tube voltage: 40 KV; tube current: 69 mA). In order to heighten the resolving power of a diffractometer, it is necessary to properly select a width of a slit (e.g., radiation slit, light receiving slit, etc.), a time constant of the meter, a scanning speed of a goniometer, and a recording speed and to confirm the measurement system by using a standard sample, e.g., silicon, etc.

When emulsion grains have a distinct stratiform structure composed of two parts, the diffraction curve shows two peaks of the diffraction maximum due to silver halides in the high iodide content core and the diffraction maximum due to silver halides in the low iodide content shell part of the uppermost layer.

When emulsion grains have a distinct stratiform structure composed of substantially two parts, the following observation can be obtained. That is, when a diffraction intensity vs. diffraction angle curve of a (220) face of silver halides is obtained by using a Kβ ray of Cu at an angle of diffraction ($2\theta$) in the range of from 38° to 42°, peaks appear consisting of a diffraction peak corresponding to a high iodide content core containing from 10 to 45 mol% of silver iodide, a diffraction peak corresponding to a low iodide content shell part of the uppermost layer containing not more than 5 mol% of silver iodide and one minimum between these two maxima. The peak corresponding to the high iodide layer shows a diffraction intensity of from 1/10 to 3/1 as compared to the peak of the low iodide content shell part, preferably from 1/5 to 3/1, and more preferably from 1/3 to 3/1, as compared to the peak of the low iodide content shell part.

The minimum diffraction intensity between the two peaks is preferably not more than 90%, more preferably not more than 80%, and most preferably not more than 60%, of the diffraction maximum (peak) having a lower intensity. The technique for resolving the diffraction curve comprising two diffraction components is well known and is explained, e.g., in *Jikken Butsurigaku Koza* 11, *Koshi Kekkan,* Kyoritsu Shuppan.

It is also useful to analyze the curve by the use of a Curve Analyzer (produced by Du Pont) by postulating the curvature as a Gauss' function or a Lorentz' function.

In the above-described X-ray analysis, two peaks also appear in the case of an emulsion wherein two kinds of grains having no distinct stratiform structure and differing in halogen composition are copresent. Application of an EPMA method (Electron-probe Micro Analyzer method) in combination with X-ray diffractometry makes it possible to judge whether a silver halide emulsion comprises grains having a distinct stratiform structure of the present invention or two different kinds of grains.

According to the EPMA method, an electron beam is irradiated on a sample emulsion which is prepared by thoroughly dispersing the grains so as not to contact with each other. Elementary analysis of a very minute structure can be made by X-ray analysis by electron excitation. The halogen composition of individual grains can be decided by obtaining characteristic X-ray intensities of silver and iodine emitted from the individual grains. Whether an emulsion comprises grains having a distinct stratiform ture or not would be judged by confirming the halogen composition of at least 50 grains by the EPMA method.

It is preferable that the emulsion having a distinct stratiform structure has an iodide content as uniform as possible among the individual grains. More specifically, the iodide content distribution among the grains as determined by the EPMA method preferably has a relative standard deviation of not more than 50%, more preferably not more than 35%, and most preferably not more than 20%.

In order to assure favorable photographic properties from the emulsion comprising silver halide grains have a distinct stratiform structure, the silver halides of high iodide content as a core should be covered sufficiently with shell silver halides of low iodide content. A requisite shell thickness varies depending on the grain size. For example, large grains having a grain size of 1.0 μm or more preferably have a shell thickness of at least 0.1 μm, and small grains having a grain size of less than 1.0 μm preferably have a shell thickness of at least 0.05 μm. In order to obtain an emulsion comprising grains having a distinct stratiform structure, the silver content ratio of the core part to the shell part preferably ranges from 1/5 to 5/1 more preferably from 1/5 to 3/1, and most preferably from 1/5 to 2/1.

As described above, the silver halide grains according to the present invention have a distinct stratiform structure composed of substantially two parts, which means that two areas being different in halogen composition substantially exist in the individual grains, the central area being designated as a core and the surface area being designated as a shell.

The term "substantially two parts" as having been herein used means that the grains may have a third area in addition to the core and shell, for example, an interlayer between the core and the shell. However, such a third area, if any, should not give any substantial influence on the shapes of the two peaks which correspond the high iodide area and the low iodide area of an X-ray diffraction pattern obtained as described above. This should apply to a third area that may exist within the core.

The silver halide emulsion layer of the present invention may contain, in addition to the mono-dispersed grains, poly-dispersed silver halide grains, i.e., those having a coefficient of variation exceeding 0.25. Preferred silver halides include silver iodobromide or silver iodochlorobromide containing not more than about 30 mol% of silver iodide. The most preferred silver halide is silver iodobromide containing from about 2 mol% to about 25 mol% of silver iodide.

The silver halide grains which can be used in combination may have a regular crystal form, such as a cube, an octahedron, a tetradecahedron, etc., an irregular crystal form, such as a sphere, etc., a crystal form having a lattice defect, such as a twinning plane, or a composite form thereof.

The silver halide grains which can be used in combination may be fine grains having a diameter of about 0.1 μm or less or giant grains having a project area diameter reaching about 10 μm.

Tabular grains having an aspect ratio of about 5 or more can also be used in combination. Such tabular grains can easily be prepared by known methods as disclosed in Gutoff, *Photographic Science and Engineering*, Vol. 14, 248–257 (1970), U.S. Pat. Nos. 4,434,226, 4,414,310, 4,433,048 and 4,439,520 and British Pat. No. 2,112,157. U.S. Pat. No. 4,434,226 teaches that use of the tabular grains advantageously improves efficiency of color sensitization by sensitizing dyes, graininess, sharpness, and the like.

The bath chiefly having bleaching ability which can be used in this invention (hereinafter simply referred to as a bleaching bath) is a bath that contains bleaching components aimed at bleaching the developed silver. More specifically, the bleaching bath is capable of bleaching at least $\frac{1}{2}$, preferably at least $\frac{2}{3}$, and more preferably at least 4/5, the maximum amount of developed silver contained in the color light-sensitive material. The bleaching bath may also have desilvering capability, but such desilvering capacity should be less than $\frac{1}{2}$, preferably less than $\frac{1}{3}$, and more preferably less than 1/5, the total silver coverage of the color light-sensitive material.

The bath having bleach-fixing ability which can be used in the present invention (hereinafter simply referred to as a bleach-fixing bath) is a bath capable of bleaching developed silver which remains unbleached in the bleaching bath and also capable of desilvering both the silver halide formed by the bleach and the silver halide which has not undergone desilvering in the bleaching bath. Such a bleach-fixing bath contains not less than 0.05 mol of a bleaching agent per liter. More specifically, the bleach-fixing bath is capable of bleaching at most less than $\frac{1}{2}$ preferably less than $\frac{1}{3}$, and more preferably less than 1/5, the maximum developed silver content contained in the color light-sensitive material and capable of desilvering at least $\frac{1}{2}$, preferably at least $\frac{2}{3}$, and more preferably at least 4/5, the total silver coverage of the color light-sensitive material.

The above-described bleaching bath and bleach-fixing bath comprise 4 or less baths in total, each of which may be composed of 2 or more baths. The desilvering processing may further include a washing step (inclusive of a washing bath with a reduced amount of water) between the bleaching bath and the bleach-fixing bath. Further, a bleaching solution overflowed from the bleaching bath resulting from replenishing can be introduced into the bleach-fixing bath either directly or indirectly, and preferably into the bleach-fixing bath directly connected to the bleaching bath, whereby a part or the whole of a bleaching agent to be replenished to the bleach-fixing solution may be saved.

The bleaching agent which can be used in the bleaching bath and bleach-fixing bath can be selected arbitrarily from among known compounds, such as potassium ferricyanide, bichromates, persulfates, inorganic ferric salts, organic ferric salts, and the like. Of these, aminopolycarboxylic acid ferric complex salts, that is, complexes formed by a ferric ion and an aminopolycarboxylic acid or a salt thereof, are particularly preferred because they cause less water pollution and corrosion of metals and are also stable.

Typical examples of the aminopolycarboxylic acids and salts thereof are shown below.

A-1: Ethylenediaminetetraacetic acid
A-2: Disodium ethylenediaminetetraacetate
A-3: Diammonium ethylenediaminetetraacetate
A-4: Trimethylammonium ethylenediaminetetraacetate
A-5: Tetrapotassium ethylenediaminetetraacetate
A-6: Tetrasodium ethylenediaminetetraacetate
A-7: Trisodium ethylenediaminetetraacetate
A-8: Diethylenetriaminepentaacetic acid
A-9: Pentasodium diethylenetriaminepentaacetate
A-10: Ethylenediamine-N-(β-oxyethyl)-N,N',N'-triacetic acid A-11: Trisodium ethylenediamine-N-(β-oxyethyl)-N,N',N'-triacetate
A-12: Triammonium ethylenediamine-N-(β-oxyethyl)-N,N',N'-triacetate
A-13: Propylenediaminetetraacetic acid
A-14: Disodium propylenediaminetetraacetate
A-15: Nitrilotriacetic acid
A-16: Trisodium nitrilotriacetate
A-17: Cyclohexanediaminetetraacetic acid
A-18: Disodium cyclohexanediaminetetraacetate
A-19: Iminodiacetic acid
A-20: Dihydroxyethylglycine
A-21: Ethyl ether diaminetetraacetic acid
A-22: Glycol ether diaminetetraacetic acid
A-23: Ethylenediaminetetrapropionic acid These examples are not intended to limit the present invention. Of these, A-1 to A-3, A-8 and A-17 are particularly preferred.

The aminopolycarboxylic acid ferric complex salt may be added in the form of a complex salt, or the ferric complex salt may be formed in situ by using a ferric salt, e.g., ferric sulfate, ferric chloride, ferric nitrate, ammonium ferric sulfate, ferric phosphate, etc., and an aminopolycarboxylic acid in a solution. In the former case, two or more kinds of complex salts may be used in combination. In the latter case, two or more kinds of ferric salts and/or aminopolycarboxylic acids may be used in combination, and the aminopolycarboxylic acid may be used in excess amount above that required for formation of a ferric complex salt.

The above-described bleaching bath or bleach-fixing bath containing the ferric complex can further contain complex salts of metal ions other than iron, e.g., cobalt, copper, etc.

The bleaching bath or bleach-fixing bath of the present invention can furthermore contain a halogenating agent, such as a bromide (e.g., potassium bromide, sodium bromide, ammonium bromide, etc., hereinafter described in detail), a chloride (e.g., potassium chloride, sodium chloride, ammonium chloride, etc.), and the like. In addition, the bleaching bath or bleach-fixing bath may contain a nitrate (e.g., sodium nitrate, ammonium nitrate, etc.), one or more inorganic acids, organic acids and their salts having buffer capacity (e.g., boric acid, borax, sodium metaborate, acetic acid, sodium acetate, sodium carbonate, potassium carbonate, phosphorous acid, phosphoric acid, sodium phosphate, citric aicd, sodium citrate, tartaric acid, etc.) and a compound having a fixing capacity, such as thiosulfates (e.g., sodium thiosulfate, ammonium thiosulfate, ammonium sodium thiosulfate, potassium thiosulfate, etc.), thiocyanates (e.g., sodium thiocyanate, ammonium thiocyanate, potassium thiocyanate, etc.), thiourea, thioethers, etc.

If desired, various additives can also be incorporated in the bleaching or bleach-fixing bath, etc. Examples of usable additives include sulfites (e.g., sodium sulfite, ammonium sulfite, etc.), various defoaming agents, surface active agents, iodides (e.g., potassium iodide, sodium iodide, ammonium iodide, etc.) and bisulfite adducts of hydroxylamine, hydrazine or aldehyde compounds.

The bleaching solution which can be used in the invention contains from 0.1 to 1 mol, and preferably from 0.2 to 0.5 mol, of the bleaching agent per liter of the bleaching solution and has a pH on use of from 4.0 to 8.0, and preferably from 5.5 to 7.5.

The bleach-fixing solution which can be used in the invention contains from 0.05 to 0.5 mol, and preferably from 0.1 to 0.3 mol, of a bleaching agent per liter of the bleach-fixing solution and from 0.3 to 3 mols, and preferably from 0.5 to 2.5 mols, of a fixing agent per liter of the bleach fixing solution and has a pH of from 5 to 8, and preferably from 6 to 7.5.

As described above, the bleaching bath and/or the bleach-fixing bath can contain a water-soluble bromide. The water-soluble bromide is a compound capable of releasing a bromine ion when dissolved in the bleaching bath or bleach-fixing bath. Specific examples of such a water-soluble bromide are alkali metal bromides, e.g., potassium bromide, sodium bromide, lithium bromide, etc., ammonium bromide, hydrobromic acid, alkaline earth metal bromides, e.g., magnesium bromide, calcium bromide, strontium bromide, etc. Among these water-soluble bromides, ammonium bromide is particularly preferred.

In the present invention, such a water-soluble bromide is preferably present in the bleaching solution in an amount of from 0.5 to 1.3 mol, and more preferably from 0.7 to 1.3 mol, per liter. When the water-soluble bromide is incorporated into the bleach-fixing solution in an amount of preferably from 0.1 to 0.5 mol, and more preferably from 0.2 to 0.5 mol, per liter, further improved results can be obtained, which constitutes a particularly preferred embodiment of the present invention.

In order to accelerate bleach, a bleach accelerator can be added to the bleaching bath and/or bleach-fixing bath and preferably at least to the bleaching bath.

The bleach accelerator to be incorporated to the bleaching bath can be selected arbitrarily from known bleach accelerators. It is particularly preferable to use, as a bleach accelerator, at least one compound selected from a compound having a mercapt group or a disulfide linkage, a thiazolidine derivative, a thiourea derivative, or an isothiourea derivative. And these compounds markedly heighten the effects of bleach acceleration not only over the cases where these bleach accelerators are incorporated in a bleaching bath according to a conventional bleaching or fixing step but also over any other cases known in the conventional bleaching bath and desilvering processing arts. Among the above-recited bleach accelerators, those represented by the following formulae (I) to (IX) are particularly preferred:

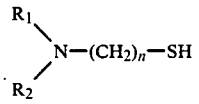

(I)

wherein $R_1$ and $R_2$, which may be the same or different, each represents a hydrogen atom, a substituted or unsubstituted lower alkyl group (preferably the one having from 1 to 5 carbon atoms, and more preferably a methyl group, an ethyl group and a propyl group) or an acyl group (preferably the one having from 1 to 3 carbon atoms, e.g., an acetyl group, a propionyl group, etc.); or $R_1$ and $R_5$ may be taken together to form a ring; and n represents an integer of from 1 to 3.

$R_1$ and $R_2$ each more preferably represents a substituted or unsubstituted lower alkyl group.

Substituents for the substituted lower alkyl group as $R_1$ or $R_2$ include a hydroxyl group, a carboxyl group, a sulfo group, an amino group, etc.

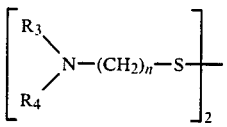

(II)

wherein $R_3$ and $R_4$, which may be the same or different, have the same meaning as for $R_1$ and $R_2$ in the formula (I); and n is as defined above.

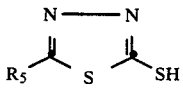

(III)

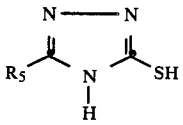

(IV)

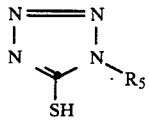

(V)

wherein $R_5$ represents a hydrogen atom, a halogen atom (e.g., a chlorine atom, a bromine atom, etc.), an amino group, a substituted or unsubstituted lower alkyl group (preferably the one having from 1 to 5 carbon atoms, and more preferably a methyl group, an ethyl group or a propyl group) or an alkylamino group (e.g., a methylamino group, an ethylamino group, a dimethylamino group, a diethylamino group, etc.).

Substituents as possessed by $R_5$ include a hydroxyl group, a carboxyl group, a sulfo group, an amino group, etc.

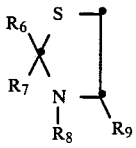

(VI)

wherein $R_6$ and $R_7$, which may be the same or different, each represents a hydrogen atom, a substituted or unsubstituted alkyl group (preferably a lower alkyl group, e.g., a methyl gorup, an ethyl group, a propyl group, etc.), a substituted or unsubstituted phenyl group or a substituted or unsubstituted heterocyclic group (more specifically, a heterocyclic group containing at least one hetero atom, e.g., a nitrogen atom, an oxygen atom, a sulfur atom, etc., such as a pyridine ring, a thiophene ring, a thiazolidine ring, a benzoxazole ring, a benzotriazole ring, a thiazole ring, an imidazole ring, etc.); $R_8$ represents a hydrogen atom or a substituted or unsubstituted lower alkyl group (preferably the one having from 1 to 3 carbon atoms, e.g., a methyl group, an ethyl group, etc.); and $R_9$ represents a hydrogen atom or a carboxyl group.

Substituents possessed by $R_6$, $R_7$ or $R_8$ include a hydroxyl group, a carboxyl group, a sulfo group, an amino group, a lower alkyl group, etc.

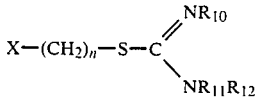

(VII)

wherein $R_{10}$, $R_{11}$ and $R_{12}$, which may be the same or different, each represents a hydrogen atom or a lower alkyl group (preferably the one having from 1 to 3 carbon atoms, e.g., a methyl group, an ethyl group, etc.); $R_{10}$ and either of $R_{11}$ and $R_{12}$ may be taken together to form a ring; and X represents a substituted or unsubstituted amino group, a sulfonic acid group or a carboxyl group.

Substituents for the substituted amino group as X include a lower alkyl group, e.g., a methyl group, etc., an alkoxyalkyl group, e.g., an acetoxymethyl group, etc., and the like.

$R_{10}$, $R_{11}$ and $R_{12}$ each more preferably represents a hydrogen atom, a methyl group or an ethyl group, and X preferably represents an amino group or a dialkylamino group.

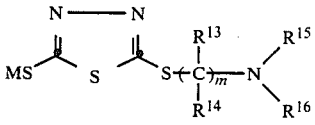

(VIII)

wherein $R^{13}$ and $R^{14}$ each represents a hydrogen atom, a hydroxyl group, a substituted or unsubstituted amino group, a carboxyl group, a sulfo group or a substituted or unsubstituted alkyl group; $R^{15}$ and $R^{16}$ each represents a hydrogen atom, a substituted or unsubstituted alkyl group or a substituted or unsubstituted acyl group; or $R^{15}$ and $R^{16}$ may be taken together to form a ring; M represents a hydrogen atom, an alkali metal atom or an ammonium group; and m represents an integer of from 2 to 5.

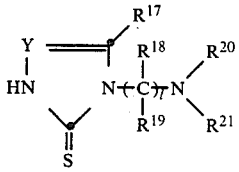

(IX)

wherein Y represents N or C-R; R, $R^{17}$, $R^{18}$ and $R^{19}$ each represents a hydrogen atom, a halogen atom, an amino group, a hydroxyl group, a carboxyl group, a sulfo group or a substituted or unsubstituted amino group; $R^{20}$ and $R^{21}$ each represents a hydrogen atom, a substituted or unsubstituted alkyl group or an acyl group, or $R^{20}$ and $R^{21}$ may be taken together to form a ring, with the proviso that $R^{20}$ and $R^{21}$ do not simultaneously represent hydrogen atoms; and l represents 0 or an integer of from 1 to 5.

Preferred specific examples of the compounds represented by the formulae (I) to (IX) are shown below:

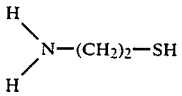

(I)-(1)

-continued
(I)-(2)
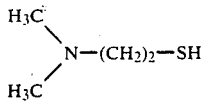
(I)-(3)
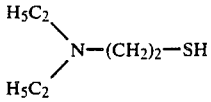
(I)-(4)
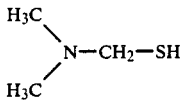
(I)-(5)
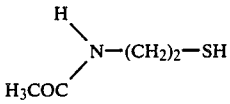
(I)-(6)
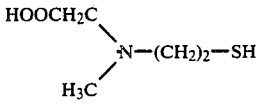
(I)-(7)
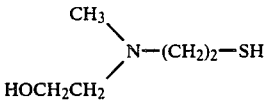
(I)-(8)
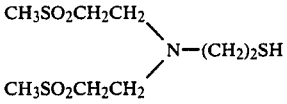
(I)-(9)
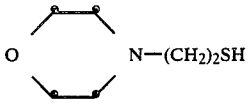
(II)-(1)
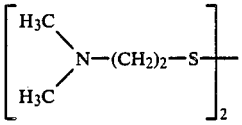
(II)-(2)
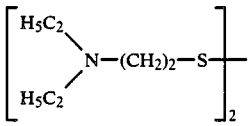
(II)-(3)
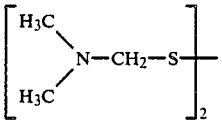
(II)-(4)
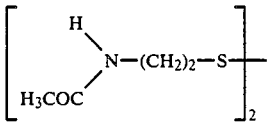
(II)-(5)
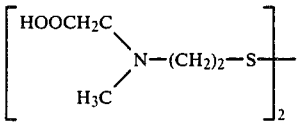
-continued
(II)-(6)
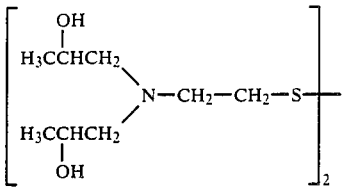
(II)-(7)
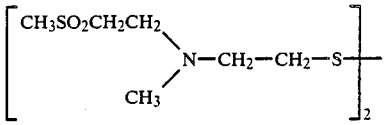
(II)-(8)
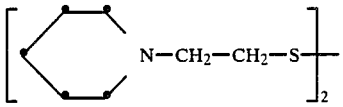
(II)-(9)
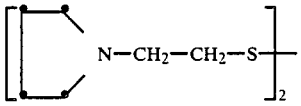
(II)-(10)
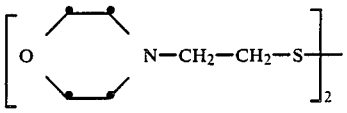
(III)-(1)
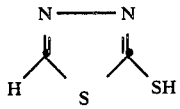
(III)-(2)
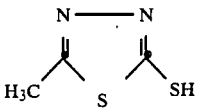
(III)-(3)
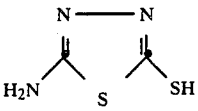
(III)-(4)
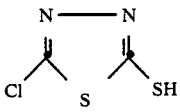
(III)-(1)
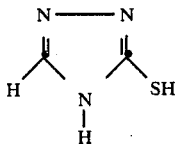
(IV)-(2)
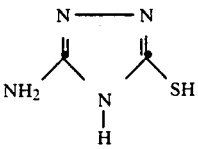

-continued
(IV)-(3)
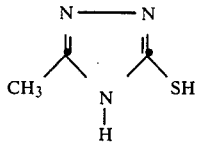
(V)-(1)
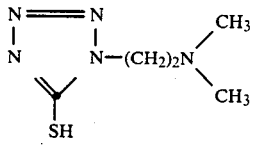
(V)-(2)
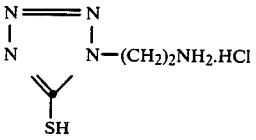
(VI)-(1)
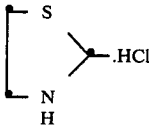
(VI)-(2)
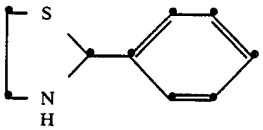
(VI)-(3)
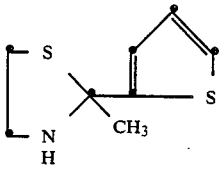
(VI)-(4)
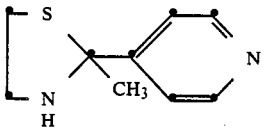
(VI)-(5)
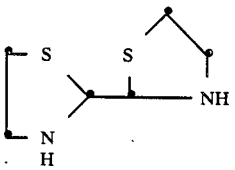
(VI)-(6)
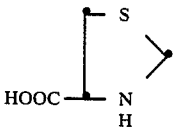
(VII)-(1)
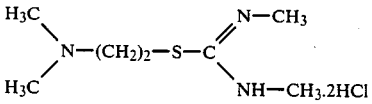
(VII)-(2)
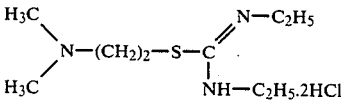
-continued
(VII)-(3)
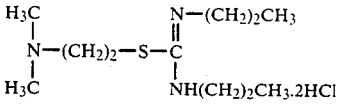
(VII)-(4)
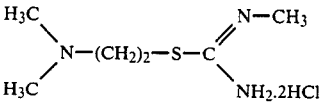
(VII)-(5)
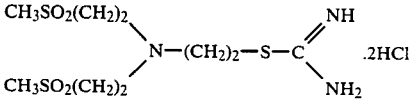
(VII)-(6)
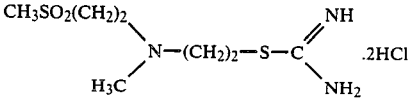
(VII)-(7)
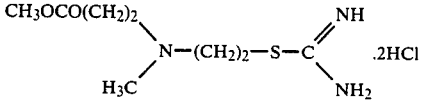
(VII)-(8)
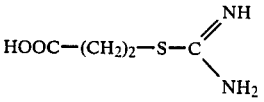
(VII)-(9)
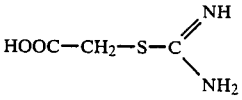
(VII)-(10)
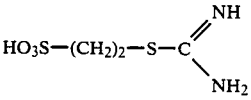
(VII)-(11)
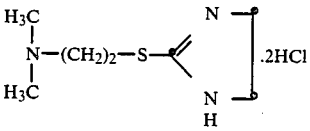
(VII)-(1)
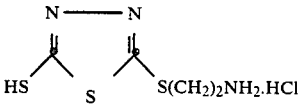
(VII)-(2)
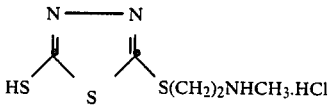
(VII)-(3)
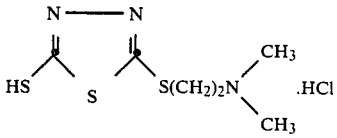
(IX)-(1)
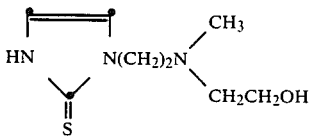

-continued

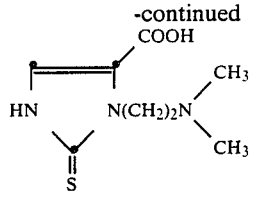

(IX)-(2)

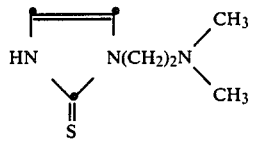

(IX)-(3)

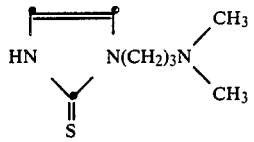

(IX)-(4)

Any of the above-described compounds can be synthesized by known processes. In some detail, the compounds of the formula (I) can be synthesized by the process disclosed in U.S. Pat. No. 4,285,984, G. Schwarzenbach et al. *Helv. Chim. Acta.*, 38, 1147 (1945), R. O. Clinton et al., *J. Am. Chem. Soc.*, 70, 950 (1948), etc. The compounds of the formula (II) can be synthesized by the process disclosed in Japanese Patent Application (OPI) No. 95630/78. The compounds of the formulae (III) and (IV) can be prepared by the process disclosed in Japanese Patent Application (OPI) No. 52534/79. The compounds of the formula (V) can be prepared by the process of Japanese Patent Application (OPI) Nos. 68568/76, 70763/76 and 50169/78. The compounds of the formula (VI) can be prepared by the process disclosed in Japanese Patent Publication No. 9854/78 and Japanese Patent Application (OPI) No. 214855/84. The compounds of the formula (VII) can be prepared by the process disclosed in Japanese Patent Application (OPI) No. 94927/78. The compounds of the formula (VIII) can easily be synthesized by alkylation of 2,5-dimercapto-1,3,4-thiadiazole on referring to *Advanced in Heterocyclic Chemistry*, Vol. 9, pp. 165–209 (1968). The compounds of the formula (IX) can be synthesized in accordance with the processes disclosed, e.g., in A. Wohl and W. Marckwald, *Ber.*, Vol. 22, p. 568 (1889), M. Freund, *Ber.*, Vo. 29, p. 2483 (1896), A. P. T. Eesson et al., *J. Chem. Soc.*, Vol. 1932, p. 1806, R. G. Jones et al., *J. Am. Chem. Soc.*, Vol. 71, p. 4000 (1949), etc.

These bleach accelerators are usually added to a processing solution in the form of a solution dissolved in water, an alkali, an organic solvent, etc., but addition in the form of a powder may also be effective.

The amount of the bleach accelerator, especially the compounds having a mercapto group or a disulfide linkage in their molecule, thiazoline derivatives or isothiourea derivatives, to be added to the bleaching solution varies depending on the type of photographic materials to be processed, the processing temperature, the processing time, and the like, but usually ranges from $1\times10^{-5}$ to $1\times10^{-1}$ mol, and preferably from $1\times10^{-4}$ to $5\times10^{-2}$ mol, per liter of the processing solution.

The silver halide photographic emulsion which can be used in the color light-sensitive materials of the present invention can be prepared according to known processes. Reference can be made to it, for example, in *Research Disclosure*, Vol. 176, No. 17643, pp 22–23, "I. Emulsion Preparation and Types" (December, 1978) and ib., Vol. 187, No. 18716, p. 648 (November, 1976).

The photographic emulsion to be used in the color light-sensitive materials of the present invention can be prepared according to known processes as described, e.g., in P. Grufkids, *Chimie et Physique Photographique*, Paul Montel (1967), G. F. Duffin, *Photographic Emulsion Chemistry*, Focal Press (1966), V. L. Zelikman et al., *Making and Coating Photographic Emulsion*, Focal Press (1964), etc.

In the preparation of the photographic emulsions, various silver halide solvents can be employed, if desired. Examples of usable silver halide solvents include ammonia, potassium thiocyanate and thioethers and thione compounds as described in U.S. Pat. No. 3,271,157 and Japanese Patent Application (OPI) Nos. 12360/76, 82408/78, 144319/78, 100717/79 and 155828/79.

In the formation of silver halide grains or in the step of physical ripening, a cadmium salt, a zinc salt, a lead salt, a thallium salt, an iridium salt or a complex salt thereof, a rhodium salt or a complex salt thereof, an iron salt or a complex salt thereof, etc. may coexist.

The emulsions may usually be subjected to physical ripening, chemical ripening and spectral sensitization. Additives to be used in these steps as well as other photographic additives are known as disclosed in the above-cited *Research Disclosure* (RD) Nos. 17643 and 18716. These additives and their sources are tabulated below.

| Additive | RD 17643 | RD 18716 |
|---|---|---|
| Chemical sensitizer | P23 | P648, RC (right column) |
| Sensitivity increasing agent | — | P648, RC (right column) |
| Spectral sensitizer, Supersensitizer | PP23–24 | P648, RC-P649, RC |
| Brightening agent | P24 | — |
| Antifoggant and stabilizer | PP24–25 | P649, RC |
| Light-absorbing agent, filter dye, ultraviolet absorbent | PP25–26 | P649, RC-P650, LC (left column) |
| Stain inhibitor | P25, RC | P650, LC to RC |
| Dye image stabilizer | P25 | — |
| Hardener | P26 | P651, LC |
| Binder | P26 | " |
| Plasticizer, lubricant | P27 | P650, RC |
| Coating aid, surface active agent | pp26–27 | " |
| Antistatic agent | P27 | " |

Yellow couplers which can be used in the color light-sensitive material of the invention typically include hydrophobic acylacetamido couplers having a ballast group. Specific examples of such couplers are described in U.S. Pat. Nos. 2,407,210, 2,875,057 and 3,265,506.

According to the processing of the present invention, use of 2-equivalent yellow couplers is preferred. Typical examples of 2-equivalent yellow couplers include the oxygen atom-release type yellow couplers described, e.g., in U.S. Pat. Nos. 3,408,194, 3,447,928, 3,933,501 and 4,022,620; and the nitrogen atom-release type yellow couplers described, e.g., in Japanese Patent Publication No. 10739/83, U.S. Pat. Nos. 4,401,752 and 4,326,024, RD 18053 (April, 1979), British Pat. No. 1,425,020 and West German Patent Publication Nos. 2,219,917, 2,261,361, 2,329,587 and 2,433,812. α-

Pivaloylacetanilide couplers are excellent in fastness, particularly light-fastness, of developed dyes, and α-benzoylacetanilide couplers provide high color densities.

Magenta couplers which can be used in the invention include indazolone or cyanoacetyl couplers, and preferably 5-pyrazolone and pyrazoloazole couplers, which have a ballast group and are thereby hydrophobic. Of the 5-pyrazolone couplers, those having an arylamino group or acylamino group at their 3-position are preferred in view of hue or color density of developed dyes. Typical examples of such couplers are described in U.S. Pat. Nos. 2,311,082, 2,343,703, 2,600,788, 2,908,573, 3,062,653, 3,152,896 and 3,936,015, etc. Preferred releasing groups for the 2-equivalent 5-pyrazolone couplers include groups releasable via a nitrogen atom as described in U.S. Pat. No. 4,310,619 and arylthio groups as described in U.S. Pat. No. 4,351,897. The 5-pyrazolone couplers having a ballast group described in European Pat. No. 73,646 provide high color densities. Examples of the pyrazoloazole couplers include pyrazolobenzimidazoles as described in U.S. Pat. No. 3,061,432, and preferably pyrazolo[5,1-c][1,2,4]triazoles a disclosed in U.S. Pat. No. 3,725,067, pyrazolotetrazoles as disclosed in Research Disclosure (RD) No. 24220 (June, 1984) and Japanese Patent Application (OPI) No. 33552/85, and pyrazolopyrazoles as disclosed in RD 24230 (June, 1984) and Japanese Patent Application (OPI) No. 43659/85. In view of small side absorption and high light-fastness of the developed dye, the imidazo[1,2-b]pyrazoles disclosed in U.S. Pat. No. 4,500,630 are preferred, and the pyrazolo[1,5-b][1,2,4]triazole disclosed in European Pat. No. 119,860A is particularly preferred.

In the processing according to the present invention, use of cyan couplers represented by the following formula (X) or (XI) is particularly preferred since a cyan color can be color-restored satisfactorily without softening the gradation of a cyan image:

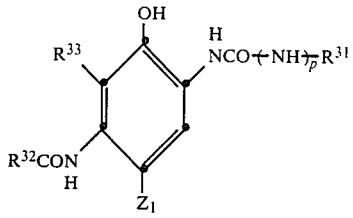

(X)

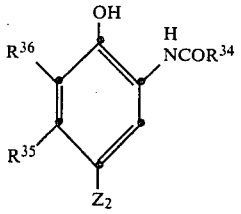

(XI)

wherein $R^{31}$, $R^{32}$ and $R^{34}$ each represents a substituted or unsubstituted aliphatic hydrocarbon group, an aryl group or a heterocyclic group; $R^{33}$ and $R^{36}$ each represents a hyrogen atom, a halogen atom, a substituted or unsubstituted aliphatic group, an aryl group or an acylamino group, or $R^{32}$ or $R^{33}$ each represents a non-metallic atom group to jointly form a nitrogen-containing 5- or 6-membered ring; $R^{35}$ represents a substituted or unsubstituted alkyl group; $Z_1$ and $Z_2$ each represents a hydrogen atom or a group releasable upon oxidative coupling reaction with a developing agent; and p represents 0 or 1.

Specific examples of the cyan couplers represented by the formula (X) or (XI) are shown below:

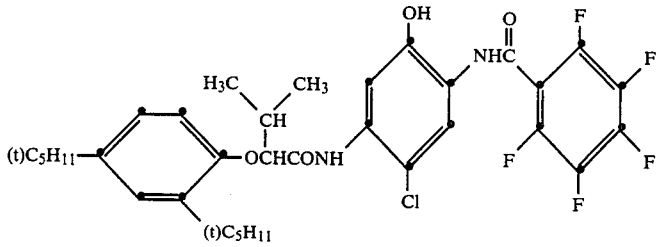

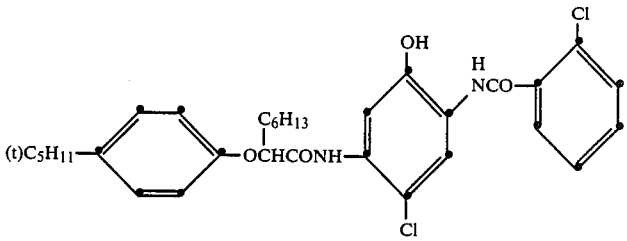

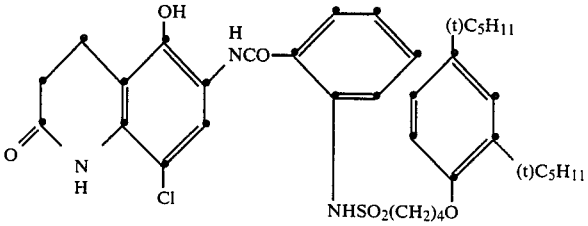

-continued

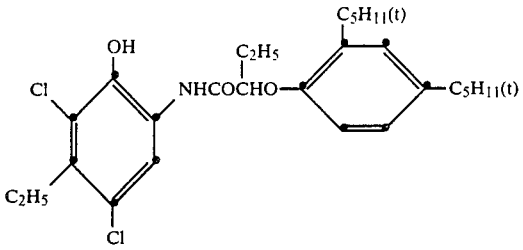

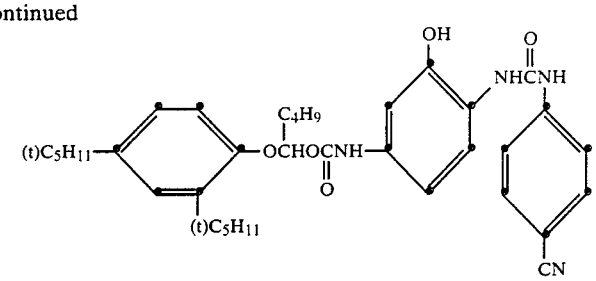

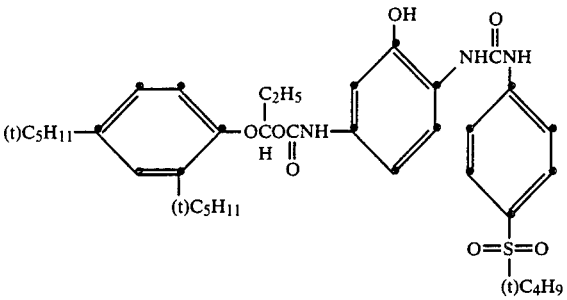

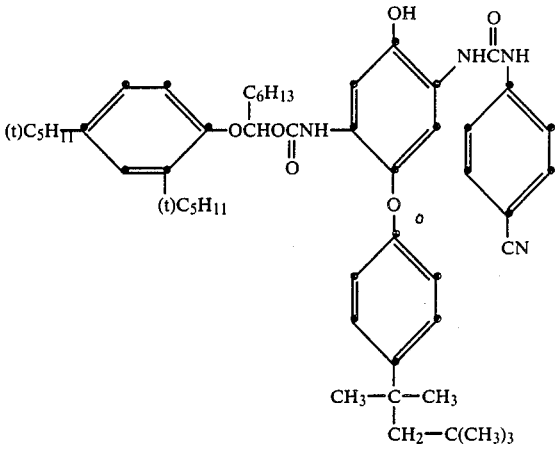

Other examples of the couplers (X) or (XI) in addition to those illustrated above include phenol couplers described in U.S. Pat. No. 3,772,002 and 2,5-diacylaminophenol couplers described in U.S. Pat. Nos. 2,772,162, 3,758,308, 4,126,396, 4,334,011 and 4,327,173, West German Patent Application (OLS) No. 3,329,729 and European Pat. No. 121,365, etc.

Another type of cyan couplers to which the present invention is suitably applicable is a 5-amido-substituted naphtol type coupler. Specific examples of such couplers are described in Japanese Patent Application (OPI) Nos. 237448/85, 153640/86, and 145557/86. One of these compounds is shown below:

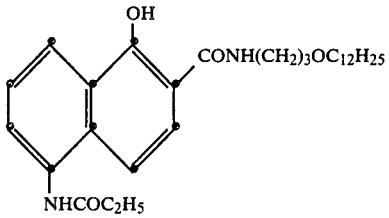

Cyan couplers which can be used in combination with the above-described cyan couplers typically include naphthol couplers as described in U.S. Pat. No. 2,474,293, and preferably oxygen atom-releasing type 2-equivalent naphthol couplers as described in U.S. Pat. Nos. 4,052,212, 4,146,396, 4,228,233 and 4,296,200.

In order to correct unwanted absorption of developed dyes, color negative light-sensitive materials for photography preferably contain colored couplers in combination to effect masking. Usable colored couplers are described in *Research Disclosure,* No. 17643, VII-G.

Graininess can be improved by using couplers which produce dyes having moderate diffusibility. Specific examples of such couplers are described in U.S. Pat. No. 4,366,237 and British Pat. No. 2,125,570 as to magenta couplers and in Europena Pat. No. 96,570 and West German Patent Publication No. 3,234,533 as to yellow, magenta or cyan couplers.

The dye forming couplers and the above-described special couplers may be in the form of polymers inclusive of dimers. Typical examples of polymerized dye forming couples are described in U.S. Pat. Nos. 3,451,820 and 4,080,211. Specific examples of polymerized magenta couplers are described in British Pat. No. 2,102,173 and U.S. Pat. No. 4,367,282.

Couplers capable of releasing photographically useful residues upon coupling can also be used to advantage in the present invention. For example, DIR (development inhibitor releasing) couplers disclosed in *Research Disclosure,* No. 17643, VII-F are useful.

The cyan couplers according to the present invention are used in an amount of from 0.002 to 0.5 mol per mol of light-sensitive silver halides in a layer to which they are introduced.

The above-described couplers can be introduced to light-sensitive materials by various known dispersion methods, typically including a solid dispersion method, an alkali dispersion method, preferably a latex dispersion method, and more preferably an oil-in-water dispersion method, etc. The oil-in-water dispersion method comprises dissolving the coupler in a high-boiling organic solvent having a boiling point of 175° C. or higher or a so-called auxiliary solvent having a low boiling point or a mixture thereof and finely dispersing the solution in water or an aqueous medium, e.g., a gelatin aqueous solution, in the presence of a surface active agent. Examples of the high-boiling organic solvents are described in U.S. Pat. No. 2,322,027. The dispersion may be accompanied by phase inversion. If desired, the auxiliary solvent used may be removed or reduced prior to coating by distillation, noodle washing, ultra-filtration, etc.

The light-sensitive materials to be used in the present invention may contain color fog preventing agents or color mixing preventing agents, such as hydroquinone derivatives, aminophenol derivatives, amines, gallic acid derivatives, catechol derivatives, ascorbic acid derivatives, colorless couplers, sulfonamidophenol derivatives, and the like.

The light-sensitive materials to be used in the present invention may further contain various discoloration inhibitors. Typical examples of organic discoloration inhibitors include hydroquinones, 6-hydroxycoumarones, 5-hydroxycoumarones, spirocoumarones, p-alkoxyphenols, hindered phenols mainly centering in bisphenol compounds, gallic acid derivatives, methylenedioxybenzenes, aminophenols, and ether or ester derivatives of the above-recited compounds in which a phenolic hydroxyl group thereof is silylated or alkylated. Further, metal complexes typically exemplified by bissalicylaldoximatonickel and a bis-N,N-dialkyldithiocarbamatonickel can also be employed.

The silver halide color light-sensitive material of the invention can contain therein a color developing agent or a precursor thereof for the purpose of simplification and speeding up of processing. Precursors of developing agents are preferred from the standpoint of increasing stability of the light-sensitive material. Examples of developing agent precursors to be incorporated include indoaniline compounds as described in U.S. Pat. No. 3,342,597, Schiff base compounds as described in U.S. Pat. No. 3,342,599, *Research Disclosure,* No. 14850 (August, 1976) and ib., No. 15159 (November, 1976), aldol compounds as described in ib., No. 13924, metal complex salts as described in U.S. Pat. No. 3,719,492, urethane compounds as described in Japanese Patent Application (OPI) No. 135628/78 as well as precursors of various salt types as disclosed in Japanese Patent Application (OPI) Nos. 6235/81, 16133/81, 59232/81, 67842/81, 83734/81 to 83736/81, 89735/81, 81837/81, 54430/81, 106241/81, 107236/81, 97531/82 and 83565/82, etc.

The silver halide color light-sensitive material of the invention can further contain therein various kinds of 1-phenyl-3-pyrazolidones for the purpose of accelerating color development. Typical examples of the compounds to be incorporated are described in Japanese Patent Application (OPI) Nos. 64339/81, 144547/82, 211147/82, 50532/83 to 50536/83 and 115438/83, etc.

A color developer to be used for development of the light-sensitive material of the invention is preferably an alkaline aqueous solution mainly comprising an aromatic primary amine color developing agent. The color developing agents which can be used include aminophenol compounds, and preferably p-phenylenediamine compounds. Typical examples of the p-phenylenediamine compounds are 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline and sulfates, hydrochlorides, phosphates, p-toluenesulfonates, tetraphenylborates, p-(t-octyl)benzenesulfonates, etc. of these compounds. The salts of these diamines are generally more stable than the free compounds and are, therefore, preferred.

Examples of the aminophenol derivatives which can also be used as color developing agents include o-aminophenol, p-aminophenol, 4-amino-2-methylphenol, 2-amino-3-methylphenol, 2-hydroxy-3-amino-1,4-dimethylbenzene, and the like.

In addition, color developing agents described in L. F. A. Mason, *Photographic Processing Chemistry,* pp. 226–229, The Focal Press (1966), U.S. Pat. Nos. 2,193,015 and 2,592,364, and Japanese Patent Application (OPI) No. 64933/73, etc. can also be employed. If desired, two or more color developing agents may be used in combination.

The color developer can further contain various additives, such as pH buffers, e.g., alkali metal carbonates, borates or phosphates, etc.; development restrainers or antifoggants, e.g., bromides, iodides, benzimidazoles, benzothiazoles, mercapto compounds, etc.; preservatives, e.g., hydroxylamine, triethanolamine, compounds disclosed in West German Patent Application (OLS) No. 2622950, sulfites, bisulfites, etc.; organic solvents, e.g., diethylene glycol, etc.; development accelerators, e.g., benzyl alcohol, polyethylene glycol, quaternary ammonium salts, amines, thiocyanates, 3,6l -thiaoctane-1,8-diol, etc.; dye forming couplers; competing couplers; nucleating agents, e.g., sodium boron hydride, etc.; auxiliary developing agents, e.g., 1-phenyl-3-pyrazolidone, etc.; viscosity-imparting agents; and chelating agents, such as aminopolycarboxylic acids, e.g., ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, triethylenetetraminehexaacetic acid and compounds described in Japanese Patent Application (OPI) No. 195845/83, aminophosphonic acids, e.g., 1-hydroxyethylidene-1,1'-diphosphonic acid, organic phosphonic acids described in *Research Disclosure,* No. 18170 (May, 1979), aminotris(-methylenephosphonic acid) and ethylenediamine-N,N,N',N'-tetramethylenephosphonic acid, phosphonocarboxylic acids disclosed in Japanese Patent Application (OPI) Nos. 102726/77, 42730/78, 121127/79, 4024/80, 4025/80, 126241/80, 65955/80 and 65956/80 and *Research Disclosure,* No. 18170 (May, 1979), and the like.

The color devleoping agent is usually used in an amount of from about 0.1 g to about 30 g, and preferably from about 1 g to about 15 g, per liter of a color developer. The color developer usually has a pH of 7 or more, and most commonly a pH between about 9 and about 13.

In development processing of color reversal materials, the materials are usually subjected to black-and-white development, followed by color development. In the black-and-white developer, known developing agents, such as dihydroxybenzenes, e.g., hydroquinone, hydroquinone monosulfonate, etc., 3-pyrazolidones, e.g., 1-phenyl-3-pyrazolidone, etc., aminophenols, e.g., N-methyl-p-aminophenol, etc., and combinations thereof can be used.

After the bleach-fixing step, the materials are usually subjected to washing, stabilization, and the like. In a simplified processing step, only washing is carried out, or only stabilization is carried out without any substantial washing step.

In the washing, various compounds may be used for the purpose of preventing precipitation or stabilizing washing water. Such compounds include chelating agents, e.g., inorganic phosphoric acids, aminopolycarboxylic acids, organic phosphonic acids, etc., bactericides or fungicides that prevent generation of various bacteria, algae or fungi (e.g., compounds described in *J. Antibact. Antifung. Agents,* Vol. 11, No. 5, pp. 207–223 (1983) and compounds described in H. Horiguchi,

*Bokin Bokabi no Kagaku*), metal salts, e.g., magnesium salts, aluminum salts, etc., alkali metals, ammonium salts and compounds described in West, *Photo. Sci. Eng.*, Vol. 6, pp. 344–359 (1965). In particular, addition of chelating agents, bactericides or fungicides is effective.

Washing can be effected in a multi-stage counter-current system using two or more vessels, e.g., 2 to 9 vessels, to save water. Further, washing may be replaced by multi-stage counter-current stabilization as disclosed in Japanese Patent Application (OPI) No. 8543/82. In this case, various compounds for image stabilization are added to a stabilizing bath. Such compounds include various buffers for pH adjustment (e.g., to a pH of from 3 to 8), such as borates, metaborates, borax, phosphates, carbonates, potassium hydroxide, sodium hydroxide, aqueous ammonia, monocarboxylic acids, dicarboxylic acids, polycarboxylic acids and combinations thereof, and aldehydes, e.g., formalin, etc. Other additives which can be added include chelating agents, e.g., inorganic phosphoric acids, aminopolycarboxylic acids, organic phosphonic acids, aminopolyphosphonic acids, phosphonocarboxylic acids, etc., bactericides, e.g., thiazoles, isothiazoles, halogenated phenols, sulfanilamides, benzotriazoles, etc., surface active agents, fluorescent brightening agents, hardeners, and the like. Two or more kinds of compounds for the same or different purposes may be used in combination. In addition, various ammonium salts, such as ammonium chloride, ammonium nitrate, ammonium sulfate, ammonium phosphate, ammonium sulfite, ammonium thiosulfate, etc., may also be added as a film pH adjusting agent after the processing.

In the processing of color light-sensitive materials for photography, the washing-stabilization step after bleach-fixing may be replaced by the above-described stabilization and washing (water-saving processing). In this case, when the magenta coupler is 2-equivalent, formalin in the stabilizing bath may be omitted.

Each of the above-described processing solutions is used in a temperature range of from 10° to 50° C., usually of from 33° to 38° C. Processing temperatures higher or lower than the above range may also be employed in order to accelerate the processing to reduce the processing time or in order to improve image quality or stability of the processing solution, respectively. For the purpose of saving silver of the light-sensitive materials, the materials may be subjected to intensification using a cobalt intensifier or a hydrogen peroxide intensifier as disclosed in West German Pat. No. 2,226,770 or U.S. Pat. No. 3,674,499.

If desired, the time for each processing steps may be reduced below the standard time by speeding up the process within a scope that would not give adverse influences on processing effects.

In the case of continuous processing, each processing solution can be prevented from variation in composition by using a respective replenisher to thereby obtain a constant finish. The amount of the replenisher may be reduced to half or less than half the standard amount of the replenisher for the purpose of reduction in cost, and the like.

If desired, each processing bath may be equipped with a heater, a temperature sensor, a liquid level sensor, a circulatory pump, a filter, a floating lid, a squeegee, etc.

The present invention can be applied to various types of color light-sensitive materials typically including color negative films for general use or for motion pictures, color reversal films for slides or TV, color papers, color positive films, color reversal papers, and the like. The present invention can also be applied to black-and-white light-sensitive materials utilizing mixing of three color couplers as described in *Research Disclosure*, No. 17123 (July, 1978).

EXAMPLE 1

A cellulose triacetate film support having a subbing layer was coated with each of the following layers in the order listed. The resulting film sample was designated as Sample 101.

| | | |
|---|---|---|
| **First Layer: Slow-Speed Emulsion Layer** | | |
| Negative silver iodobromide emulsion (silver iodide: 4 mol %; mean grain size: 0.5 μm) | 1.3 | g-Ag/m$^2$ |
| Sensitizing Dye I | $4.5 \times 10^{-4}$ | mol/mol-AgX (silver halide) |
| Sensitizing Dye II | $1.5 \times 10^{-4}$ | mol/mol-AgX |
| Coupler C-1 | 0.60 | g/m$^2$ |
| High-Boiling Organic Solvent HSB-1 | 0.5 | g/m$^2$ |
| Gelatin | 1.5 | g/m$^2$ |
| **Second Layer: High-Speed Emulsion Layer** | | |
| Emulsion A | 1.5 | g-Ag/m$^2$ |
| Sensitizing Dye I | $3 \times 10^{-4}$ | mol/mol-AgX |
| Sensitizing Dye II | $1 \times 10^{-4}$ | mol/mol-AgX |
| Coupler C-2 | 0.28 | g/m$^2$ |
| HSB-2 | 0.2 | g/m$^2$ |
| Gelatin | 1.8 | g/m$^2$ |
| **Third Layer: Protective Layer** | | |
| Polymethyl methacrylate particles (diameter: about 1.5 μm) | 0.1 | g/m$^2$ |
| Gelatin | 1.5 | g/m$^2$ |
| Hardener H-1 | 0.1 | g/m$^2$ |

Samples 101 to 104 were prepared in the same manner as for Sample 101 except for replacing Emulsion A in the second layer with Emulsions B to D, respectively, that were mono-dispersed emulsions according to the present invention.

The compounds used in the preparation of Samples 101 to 104 are shown below:

Sensitizing Dye I

Sodium 3-[5-chloro-2-{2-[5-chloro-3-(3-sulfonatopropyl)benzothiazolin-2-ylidene-methyl]-1-butenyl}-3-benzothiazolino]-propanesulfonate

Sensitizing Dye II

Sodium 3-[2-{3-[5,6-dichloro-1-ethyl-3-(3-sulfonatopropyl)benzimidazolin-2-ylidene]-1-propenyl}-3-naphtho[1,2-α]thiazolino]propanesulfonate

Coupler C-1

2-(2,4-Di-t-amylphenoxy)-N-{4-[3-(4-cyanophenyl-)ureido]-3-hydroxyphenyl}hexaneamide

Coupler C-2

2-(2,4-Di-t-amylphenoxy)-N-{4-[3-(4-butanesulfonylphenyl)ureido]-5-hydroxy-2-(4-methoxy)phenyl}butaneamide (Compound (11) of Japanese Patent Application (OPI) No. 49335/85)

HSB-1

Di-n-butyl phthalate

HSB-2

Tricresyl phosphate

H-1

Sodium 3,5-dichloro-1-hydroxy-s-triazine

Emulsions A to D used in Samples 101 to 104 were prepared as follows:

Emulsion A

To 12.0 l of an aqueous solution containing 240 g of inactive gelatin, 950 g of potassium bromide and 48.0 g of potassium iodide, 7.0 l of an aqueous solution containing 1,000 g of silver nitrate was added over a period of 50 minutes, while stirring the gelatin aqueous solution at 70° C., to obtain an emulsion having a silver iodide content of 5.0 mol%. After desalting in a usual manner, the emulsion was chemically sensitized with 18 mg of sodium thiosulfate and 14 mg of chloroauric acid at 60° C. for 50 minutes to prepare Emulsion A. Emulsion A had a mean grain size $\bar{r}$ of 0.9 μm and a coefficient of variation $S/\bar{r}$ of 0.42.

Emulsions B, C and D (Invention)

An emulsion comprising octahedral silver halide grains having a silver iodide content of 10 mol%, a mean grain size of 0.8 μm and a coefficient of variation of 0.24, 0.20 or 0.17 was prepared according to a controlled double jet method in the presence of ammonia. The resulting emulsion was used as a core emulsion. An outer shell comprising pure silver bromide was formed around the core emulsion grains until the silver amount in the shell became equal to that in the core. After desalting in a usual manner, each of the emulsions was chemically sensitized with 30 mg of sodium thiosulfate and 15 mg of chloroauric acid at 60° C. for 60 minutes to obtain Emulsions B, C or D, respectively. Emulsions B, C and D had a mean grain size of 1.0 μm and a coefficient of variation of 0.23, 0.18 and 0.14, respectively.

Each of Samples 101 to 104 was exposed to light at 25 CMS using a tungsten lamp through a filter so as to have a color temperature of 4800° K. and then development-processed in accordance with Processing A or B as shown below at 38° C.:

| | Processing A | Processing B |
|---|---|---|
| Color Development | 3' 15" | 3' 15" |
| Bleach | 2' | 2' |
| Bleach-Fixing | — | 3' 15" |
| Fixing | 3' 15" | — |
| Washing | 3' 15" | 3' 15" |
| Stabilization | 1' 05" | 1' 05" |

Each processing solution used in Processing A and Processing B had the following composition:

| | |
|---|---|
| **Color Developer:** | |
| Diethylenetriaminepentaacetic acid | 1.0 g |
| 1-Hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N—Ethyl-N—β-hydroxyethylamino)-2-methylaniline sulfate | 4.5 g |
| Water to make | 1.0 liter |
| | pH = 10.0 |
| **Bleaching Solution:** | |
| Ammonium (ethylenediaminetetra-acetato)ferrite | 100.0 g |
| Disodium ethylenediaminetetraacetate | 10.0 g |
| Ammonium bromide | 150.0 g |
| Ammonium nitrate | 10.0 g |
| Water to make | 1 liter |
| | pH = 6.0 |
| **Bleach-Fixing Solution:** | |
| Ammonium (ethylenediaminetetra-acetato)ferrite | 100.0 g |
| Disodium ethylenediaminetetra-acetate | 10.0 g |
| Sodium sulfite | 15.0 g |
| Aqueous solution of ammonium thio-sulfate (70 wt %) | 250.0 g |
| Water to make | 1 liter |
| | pH = 6.8 |
| **Fixing Solution:** | |
| Disodium ethylenediaminetetraacetate | 1.0 g |
| Sodium sulfite | 4.0 g |
| Aqueous solution of ammonium thio-sulfate (70 wt %) | 250.0 ml |
| Sodium bisulfite | 4.6 g |
| Water to make | 1.0 liter |
| | pH = 6.6 |
| **Stabilizer:** | |
| Formalin (40 wt %) | 2.0 ml |
| Polyoxyethylene-p-monononylphenyl ether (average degree of polymer-ization: about 10) | 0.3 g |
| Water to make | 1 liter |

Each of the thus processed film samples was determined for residual silver amount by X-ray fluorometric analysis. The results obtained are shown in Table 1 below.

TABLE 1

| Sample No. | Residual Silver Amount (μg/cm²) Processing A | Processing B | Remark |
|---|---|---|---|
| 101 | 20 | 11.0 | Comparison |
| 102 | 12 | 0.8 | Invention |
| 103 | 15 | 0.6 | " |
| 104 | 10 | 0.5 | " |

It can be seen from Table 1 that desilvering capacity can be increased greatly by using a mono-dispersed emulsion of the present invention and processing in accordance with Processing B of the present invention as compared with the conventionally known processing step (Processing A).

EXAMPLE 2

A cellulose triacetate film having a subbing layer was coated with each of the following layers in the order listed to prepare a multi-layer color light-sensitive material. The resulting material was designated as Sample 201.

| | |
|---|---|
| **First Layer: Antihalation Layer** | |
| Black colloidal silver | 0.18 g-Ag/m² |
| Gelatin | 1.28 g/m² |
| **Second Layer: Interlayer** | |
| 2,5-Di-t-pentadecylhydroquinone | 0.18 g/m² |
| Coupler C-4 | 0.06 g/m² |
| Gelatin | 1.04 g/m² |
| **Third Layer: First Red-Sensitive Emulsion Layer** | |
| Silver iodobromide emulsion (silver iodide content: 6 mol %; mean grain size: 0.5 μm) | 1.71 g-Ag/m² |
| Sensitizing Dye I | $6.9 \times 10^{-5}$ mol/mol-AgX (silver halide) |
| Sensitizing Dye II | $1.8 \times 10^{-5}$ mol/mol-AgX |
| Sensitizing Dye III | $3.1 \times 10^{-4}$ mol/mol-AgX |
| Sensitizing Dye IV | $4.0 \times 10^{-5}$ mol/mol-AgX |

-continued

| | |
|---|---|
| Coupler C-1 | 0.45 g/m$^2$ |
| Coupler C-4 | 0.020 g/m$^2$ |
| Coupler C-5 | 0.018 g/m$^2$ |
| HSB-2 | 0.31 g/m$^2$ |
| Gelatin | 1.84 g/m$^2$ |
| **Fourth Layer: Second Red-Sensitive Emulsion Layer** | |
| Silver iodobromide emulsion (silver iodide content: 5 mol %; mean grain size: 0.8 μm) | 1.15 g-Ag/m$^2$ |
| Sensitizing Dye I | $5.1 \times 10^{-5}$ mol/mol-AgX |
| Sensitizing Dye II | $1.4 \times 10^{-5}$ mol/mol-AgX |
| Sensitizing Dye III | $2.3 \times 10^{-4}$ mol/mol-AgX |
| Sensitizing Dye IV | $3.0 \times 10^{-5}$ mol/mol-AgX |
| Coupler C-6 | 0.25 g/m$^2$ |
| Coupler C-4 | 0.008 g/m$^2$ |
| Coupler C-5 | 0.018 g/m$^2$ |
| HSB-2 | 0.20 g/m$^2$ |
| Gelatin | 1.69 g/m$^2$ |
| **Fifth Layer: Third Red-Sensitive Emulsion Layer** | |
| Emulsion A | 1.90 g-Ag/m$^2$ |
| Sensitizing Dye I | $5.4 \times 10^{-5}$ mol/mol-AgX |
| Sensitizing Dye II | $1.4 \times 10^{-5}$ mol/mol-AgX |
| Sensitizing Dye III | $2.4 \times 10^{-4}$ mol/mol-AgX |
| Sensitizing Dye IV | $3.1 \times 10^{-5}$ mol/mol-AgX |
| Coupler C-7 | 0.15 g/m$^2$ |
| Coupler C-5 | 0.015 g/m$^2$ |
| HSB-1 | 0.20 g/m$^2$ |
| Gelatin | 1.63 g/m$^2$ |
| **Sixth Layer: Interlayer** | |
| Gelatin | 1.06 g/m$^2$ |
| **Seventh Layer: First Green-Sensitive Emulsion Layer** | |
| Silver iodobromide emulsion (silver iodide content: 6 mol %; mean grain size: 0.5 μm) | 0.58 g-Ag/m$^2$ |
| Sensitizing Dye V | $3.0 \times 10^{-5}$ mol/mol-AgX |
| Sensitizing Dye VI | $1.0 \times 10^{-4}$ mol/mol-AgX |
| Sensitizing Dye VII | $3.8 \times 10^{-4}$ mol/mol-AgX |
| Coupler C-8 | 0.21 g/m$^2$ |
| Coupler C-9 | 0.030 g/m$^2$ |
| Coupler C-10 | 0.052 g/m$^2$ |
| Coupler C-4 | 0.024 g/m$^2$ |
| HSB-1 | 0.25 g/m$^2$ |
| Gelatin | 0.70 g/m$^2$ |
| **Eighth Layer: Second Green-Sensitive Emulsion Layer** | |
| Silver iodobromide emulsion (silver iodide content: 5 mol %; mean grain size: 0.8 μm) | 1.70 g-Ag/m$^2$ |
| Sensitizing Dye V | $2.1 \times 10^{-5}$ mol/mol-AgX |
| Sensitizing Dye VI | $7.0 \times 10^{-5}$ mol/mol-AgX |
| Sensitizing Dye VII | $2.6 \times 10^{-4}$ mol/mol-AgX |
| Coupler C-8 | 0.15 g/m$^2$ |
| Coupler C-9 | 0.014 g/m$^2$ |
| Coupler C-10 | 0.010 g/m$^2$ |
| Coupler C-4 | 0.022 g/m$^2$ |
| HSB-1 | 0.20 g/m$^2$ |
| Gelatin | 1.9 g/m$^2$ |
| **Nineth Layer: Third Green-Sensitive Emulsion Layer** | |
| Silver iodobromide emulsion (silver iodide content: 10 mol %; mean grain size: 1.5 μm) | 2.27 g-Ag/m$^2$ |
| Sensitizing Dye V | $3.5 \times 10^{-5}$ mol/mol-AgX |
| Sensitizing Dye VI | $8.0 \times 10^{-5}$ mol/mol-AgX |
| Sensitizing Dye VII | $3.0 \times 10^{-4}$ mol/mol-AgX |
| Coupler C-8 | 0.085 g/m$^2$ |
| Coupler C-9 | 0.013 g/m$^2$ |
| Coupler C-10 | 0.011 g/m$^2$ |
| HSB-2 | 0.35 g/m$^2$ |
| Gelatin | 2.1 g/m$^2$ |
| **Tenth Layer: Yellow Filter Layer** | |
| Yellow colloidal silver | 0.05 g-Ag/m$^2$ |
| 2,5-Di-t-pentadecylhydroquinone | 0.03 g/m$^2$ |
| Gelatin | 0.95 g/m$^2$ |
| **Eleventh Layer: First Blue-Sensitive Emulsion Layer** | |
| Silver iodobromide emulsion (silver iodide content: 6 mol %; mean grain size: 0.6 μm) | 0.24 g-Ag/m$^2$ |
| Coupler C-11 | 0.72 g/m$^2$ |
| Coupler C-4 | 0.023 g/m$^2$ |
| HSB-1 | 0.28 g/m$^2$ |
| Gelatin | 1.28 g/m$^2$ |

-continued

| | |
|---|---|
| **Twelfth Layer: Second Blue-Sensitive Layer** | |
| Silver iodobromide emulsion (silver iodide content: 10 mol %; mean grain size: 1.0 μm) | 0.45 g-Ag/m$^2$ |
| Sensitizing Dye VIII | $2.1 \times 10^{-4}$ mol/mol-AgX |
| Coupler C-11 | 0.10 g/m$^2$ |
| Coupler C-4 | 0.008 g/m$^2$ |
| HSB-1 | 0.04 g/m$^2$ |
| Gelatin | 0.50 g/m$^2$ |
| **Thirteenth Layer: Third Blue-Sensitive Emulsion Layer** | |
| Silver iodobromide emulsion (silver iodide content: 10 mol %; mean grain size: 1.8 μm) | 0.77 g-Ag/m$^2$ |
| Sensitizing Dye VIII | $2.2 \times 10^{-4}$ mol/mol-AgX |
| Coupler C-11 | 0.20 g/m$^2$ |
| HSB-1 | 0.07 g/m$^2$ |
| Gelatin | 0.69 g/m$^2$ |
| **Fourteenth Layer: First Protective Layer** | |
| Silver iodobromide emulsion (silver iodide content: 1 mol %; mean grain size: 0.07 μm) | 0.5 g-Ag/m$^2$ |
| Ultraviolet Absorbent UV-1 | 0.11 g/m$^2$ |
| Ultraviolet Absorbent UV-2 | 0.17 g/m$^2$ |
| HSB-3 | 0.90 g/m$^2$ |
| **Fifteenth Layer: Second Protective Layer** | |
| Polymethylmethacrylate particles (diameter: about 1.5 μm) | 0.54 g/m$^2$ |
| Gelatin | 0.72 g/m$^2$ |

Each of the above layers further contained Gelatin Hardener H-2 or a surface active agent in addition to the above-described components.

Samples 202 to 208 were prepared in the same manner as for Sample 201 except for replacing Poly-Dispersed Emulsion A as used in the fifth layer of Sample 201 with Poly-Dispersed Emulsion E or F or Mono-Dispersed Emulsion G, H, I, J or K.

The compounds used in the preparation of Samples 201 to 208 were as follows:

Coupler C-4

4-{2-[4-(8-Acetamido-1-hydroxy-3,6-disulfo-2-naphthylazo)phenoxy]ethoxy}-1-hydroxy-N-dodecyl-2-naphthamide disodium salt Coupler C-5

N,N'-Bis[2-chloro-5-(1-dodecyloxycarbonylethoxycarbonyl)]phenyl-2-[5(or 6)-phenoxycarbonylbenzotriazol-1-yl]malondiamide Coupler C-6

2-(2,4-Di-t-amylphenoxy)-N-{4-[3-(4-cyanophenyl-)ureido]-5-hydroxy-2-(4-t-octylphenoxy)phenyl}octanamide Coupler C-7

4-[2-(1-Carboxytridecylthio)ethyloxy]-N-hexyl-2-naphthamide

Coupler C-8

Poly[1-(2,4,6-trichlorophenyl)-3-methacryloylamino-4-pyrazolyl-2-pyrazolin-5-one-co-n-butylacrylate-co-styrene] (weight ratio=45/25/30)

Coupler C-9

3-{3-[2-(2,4-Di-t-amylphenoxy)butaneamido]-benzamido}-1-(2,4,6-trichlorophenyl)-4-(4-methoxyphenylazo)-2-pyrazolin-5-one Coupler C-10

3-(2-Chloro-5-tetradecaneamidoanilino)-1-(2,4,6-trichlorophenyl)-4-(4-hydroxy-3-methylphenylazo)-2-pyrazolin-5-one Coupler C-11

2-(1-Benzyl-5-ethoxy-2,4-imidazolidinedion-3-yl)-2-(4-methoxybenzoyl)-N-(2-chloro-5-dodecyloxycarbonylphenyl)acetamide

HSB-3

Tri-n-hexyl phosphate

Sensitizing Dye III

Sodium 3-[2-{2-[5-phenyl-3-(4-sulfonatobutyl)-benzoxazolin-2-ylidenemethyl]-1-butenyl}-3-naphtho[1,2-d]thiazolino]propanesulfonate Sensitizing Dye IV Sodium 3-[2-{2-[3-(3-sulfonatopropyl)naphtho[1,2-α]thiazolin-2-ylidenemethyl]-1-butenyl}-3-naphtho[1,2-d]thiazolino]propanesulfonate Sensitizing Dye V 2-[5-Phenyl-2-{2-[5-phenyl-3-(2-sulfonatoethyl)benzoxazolino]}ethanesulfonic acid Sensitizing Dye VI Sodium 4-[5,6-dimethyl-2-{2-[5-phenyl-3-(2-sulfonatoethyl)-benzoxazolin-2-ylidenemethyl]-1-butenyl}-3-benzothiazolino]butanesulfonate Sensitizing Dye VII Sodium 3-[5,6-dichloro-2-{3-[5,6-dichloro-1-ethyl-3-(p-sulfonatophenyl)benzimidazolin-2-ylidene]-1-propenyl}-1-ethyl-3-benzimidazolino]propanesulfonate Sensitizing Dye VIII Sodium 4-{5-chloro-2-[5-chloro-3-(4-sulfonatobutyl)-benzothiazolin-2-ylidenemethyl]-3-benzothiazolino}butanesulfonate Emulsions used in the preparation of Samples 201 to 208 were prepared as follows:

Emulsions E and F

In accordance with the process for preparing Emulsion A as described in Example 1, Emulsion E having a silver iodide content of 2 mol%, a mean grain size ($\bar{r}$) of 1.3 μm and a coefficient of variation ($S/\bar{r}$) of 0.39 and Emulsion F having a silver iodide content of 6 mol%, $\bar{r}$ of 1.4 μm and $S/\bar{r}$ of 0.45 were prepared.

Emulsions G and H

Mono-Dispersed Emulsion G having a silver iodide content of 2 mol%, $\bar{r}$ of 1.4 μm and $S/\bar{r}$ of 0.17 and Mono-Dispersed Emulsion H having a silver iodide content of 6 mol%, $\bar{r}$ of 1.4 μm and $S/\bar{r}$ of 0.20 were prepared in accordance with a controlled double jet process in the presence of ammonia.

Emulsions I, J and K

In accordance with the process for preparing Emulsion B as described in Example 1, Mono-Dispersed Emulsion I having a core/shell silver amount ratio of 1/1, a core silver iodide content of 4 mol%, $\bar{r}$ of 1.4 μm and $S/\bar{r}$ of 0.16; Mono-Dispersed Emulsion J having a core/shell silver amount ratio of 1/1, a core silver iodide content of 12 mol%, $\bar{r}$ of 1.4 μm and $\bar{S}/r$ of 0.19; and Mono-Dispersed Emulsion K having a core/shell silver amount ratio of ½, a core silver iodide content of 18 mol%, $\bar{r}$ of 1.4 μm and $S/\bar{r}$ of 0.19 were prepared.

X-Ray diffraction for these emulsions revealed that the silver iodide content in the core agreed with the prescribed silver iodide content and that the shell had a silver iodide content of 0%. Further, the iodide distribution among grains in these emulsions was determined by analyzing about 100 grains per emulsion by the use of an X-ray microanalyzer. As a result, all the individual grains were found to have a silver iodide content within ±15% of the silver iodide content as prescribed for the grains as a wholw. It was confirmed from these analyses that the emulsion grains had a considerably uniform iodide distribution among themselves and the individual grains had a distinct stratiform structure.

Each of Samples 201 to 208 was subjected to exposure to light, followed by development processing in the same manner as described in Example 1 except for adding $1\times10^{-2}$ mol/l of Bleach Accelerator (1) or (2) having the following formula to the bleaching solution as used in Example 1. The residual silver amount in each of the thus processed samples was measured by X-ray fluorometric analysis, and the results obtained are shown in Table 2.

TABLE 2

| | Residual Silver Amount (μg/cm²) | | | | |
|---|---|---|---|---|---|
| | Bleach Accelerator (1) | | Bleach Accelerator (2) | | |
| Sample No. | Processing A | Processing B | Processing A | Processing B | Remar |
| 201 | 9.0 | 8.7 | 15.0 | 12.0 | Comparison |
| 202 | 9.2 | 8.6 | 15.4 | 11.6 | " |
| 203 | 9.4 | 8.7 | 15.2 | 11.8 | " |
| 204 | 8.5 | 0.9 | 14.7 | 1.5 | Invention |
| 205 | 8.1 | 0.8 | 14.8 | 1.9 | " |
| 206 | 8.3 | 0.5 | 13.9 | 1.0 | " |
| 207 | 8.4 | 0.7 | 15.1 | 1.1 | " |
| 208 | 8.5 | 0.7 | 14.7 | 1.2 | " |

Bleach Accelerator (1)

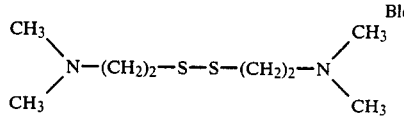

Bleach Accelerator (2)

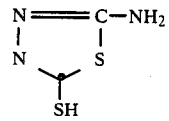

The results of Table 2 demonstrate that desilvering capacity can be greatly improved by processing the silver halide color photographic materials containing the mono-dispersed emulsions of the present invention by Processing B according to the invention which involves bleaching with a bleaching solution containing a bleach accelerator, followed by bleach-fixing as compared with the conventional processing (Processing A) which involves bleaching with a bleaching solution containing the conventional bleach accelerator.

EXAMPLE 3

When the same procedures as used in Example 1 were repeated except for replacing ammonium (ethylenediaminetetraacetato)ferrite as used in the bleaching and bleach-fixing solutions with the equal amount of ammonium (diethylenetriaminepentaacetato)ferrite, substantially the same results as in Example 1 were obtained.

As described above, the present invention realizes reduction in processing cost through reduction in overall time for development processing which can be achieved by reduction in time for bleach and fixing. Moreover, use of a color photographic light-sensitive material having a layer containing mono-dispersed silver halide grains makes it possible to assure high photographic quality of images in spite of reduced processing time.

This invention has been illustrated in great detail with reference to the above examples, but it should be understood that they are not intended to limit the present invention.

While the invention has been described in detail and with reference to specific embodiments thereof, it will be apparent to one skilled in the art that various changes and modifications can be made therein without departing from the spirit and scope thereof.

What is claimed is:

1. A method for color image formation which comprises:

(i) imagewise exposing to light a silver halide color photograph material having a silver halide emulsion layer containing mono-dispersed silver halide grains, (ii) subjecting the exposed material to color development, (iii) processing the material through a bath primarily having bleaching capacity, and then, (iv) processing the material through a bath having bleach-fixing capacity, wherein said bath primarily having bleaching capacity is capable of bleaching at least ½ the maximum amount of developed silver contained in the material and capable of desilvering less than ½ the total silver coverage of the material, and said bath having bleach-fixing capacity is capable of bleaching less than ½ the maximum developed silver content contained in the material and capable of desilvering at least ½ the total silver coverage of the material.

2. A method for color image formation as in claim 1, wherein said mono-dispersed silver halide grains have a coefficient of grain size variation of not more than 0.25.

3. A method for color image formation as in claim 1, wherein said mono-dispersed silver halide grains have a layered structure composed of substantially two distinct stratiform structures, one of which is a core having a high iodide content and the another being a shell having a low iodide content.

4. A method for color image formation as in claim 3, wherein said core comprises silver halide grain having an iodide content of from 10 to 45 mol%, and said shell comprises silver halide grain having an iodide content of not more than 5 mol%.

5. A method for color image formation as in claim 3, wherein the iodide distribution among said grains has a relative standard deviation of not more than 50%.

6. A method for color image formation as in claim 3, wherein a silver content ratio of the core to the shell ranges from 1/5 to 5/1.

7. A method of color image formation as in claim 6, wherein said bath primarily having bleaching capacity contains from 0.1 to 1 mol of a bleaching agent per liter of a bleaching solution and said bath having bleach fixing capacity contains from 0.05 to 0.5 mol of a bleaching agent per liter of a bleaching solution.

8. A method for color image formation as in claim 7, wherein said bleaching agent is an aminopolycarboxylic acid ferric complex salt.

9. A method for color image formation as in claim 6, wherein said bath primarily having bleaching capacity and/or said bath having bleach-fixing capacity contains a water-soluble bromide.

10. A method for color image formation as in claim 9, wherein said water-soluble bromide is ammonium bromide.

11. A method for color image formation as in claim 9, wherein said bath primarily having bleaching capacity contains from 0.5 to 1.3 mol of said water-soluble bromide per liter.

12. A method for color image formation as in claim 9, wherein said bath having bleach-fixing capacity contains from 0.1 to 0.5 mol of said water-soluble bromide per liter.

13. A method for color image formation as in claim 1, wherein said bath primarily having bleaching capacity contains at least one of compounds represented by the formulae (I) to (IX) as a bleach accelerator:

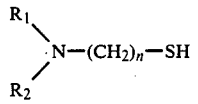

(I)

wherein $R_1$ and $R_2$, which may be the same or different, each represents a hydrogen atom, a substituted or unsubstituted lower alkyl group or an acyl group, or $R_1$ and $R_2$ may be taken together to form a ring; and n represents an integer of from 1 to 3,

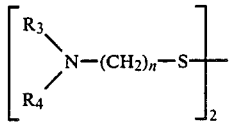

(II)

wherein $R_3$ and $R_4$, which may be the same or different, each has the same meaning as for $R_1$ and $R_2$; and n is as defined above,

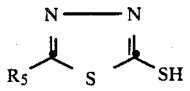

(III)

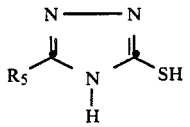

(IV)

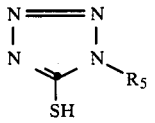

(V)

wherein $R_5$ represents a hydrogen atom, a halogen atom, an amino group, a substituted or unsubstituted lower alkyl group or an alkylamino group,

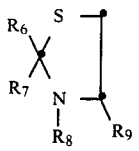

(VI)

wherein $R_6$ and $R_7$, which may be the same or different, each represents a hydrogen atom, a substituted or unsubstituted alkyl group, a substituted or unsubstituted phenyl group or a substituted or unsubstituted heterocyclic group; $R_8$ represents a hydrogen atom or a substituted or unsubstituted lower alkyl group; and $R_9$ represents a hydrogen atom or a carboxyl group,

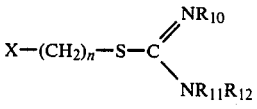

(VII)

wherein $R_{10}$, $R_{11}$ and $R_{12}$, which may be the same or different, each represents a hydrogen atom or a lower alkyl group; $R_{10}$ and either of $R_{11}$ and $R_{12}$ may be taken together to form a ring; X represents a substituted or unsubstituted amino group, a sulfonic acid group or a carboxyl group; and n is as defined above,

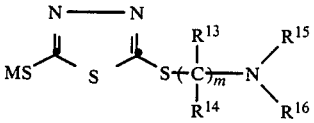

(VIII)

wherein $R^{13}$ and $R^{14}$ each represents a hydrogen atom, a hydroxyl group, a substituted or unsubstituted amino group, a carboxyl group, a sulfo group or a substituted or unsubstituted alkyl group; $R^{15}$ and $R^{16}$ each represents a hydrogen atom, a substituted or unsubstituted alkyl group or a substituted or unsubstituted acyl group; or $R^{15}$ and $R^{16}$ may be taken together to form a ring; M represents a hydrogen atom, an alkali metal atom or an ammonium group; and m represents an integer of from 2 to 5,

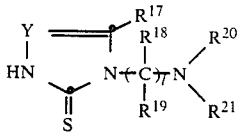

(IX)

wherein Y represents N or C-R; R, $R^{17}$, $R^{18}$ and $R^{19}$ each represents a hydrogen atom, a halogen atom, an amino group, a hydroxyl group, a carboxyl group, a sulfo group or a substituted or unsubstituted amino group; $R^{20}$ and $R^{21}$ each represents a hydrogen atom, a substituted or unsubstituted alkyl group or an acyl group, or $R^{20}$ and $R^{21}$ may be taken together to form a ring, with the proviso that $R^{20}$ and $R^{21}$ do not simultaneously represent hydrogen atoms; and l represents 0 or an integer of from 1 to 5.

14. A method of color image formation as in claim 13, wherein said bleach accelerator is present in an amount of from $1\times10^{-5}$ to $1\times10^{-1}$ mol per liter of a processing solution.

15. A method for color image formation as in claim 2, wherein said mono-dispersed silver halide grains have a coefficient of grain size variation of not more than 0.15.

16. A method for color image formation as in claim 4, wherein said core comprises silver halide grains having an iodide content of from 15 to 40 mol % and said shell comprises silver halide grains having an iodide content of not more than 2 mol%.

17. A method for color image formation as in claim 5, wherein the iodide distribution among said grains has a relative standard deviation of not more than 20%.

18. A method for color image formation as in claim 6, wherein the silver content ratio of the core to the shell ranges from 1/5 to 2/1.

19. A method for color image formation which comprises:

(i) imagewise exposing to light a silver halide color photographic material having a silver halide emulsion layer containing mono-dispersed silver halide grains, (ii) subjecting the exposed material to color development, (iii) processing the material through a bath primarily having bleaching capacity, and then (iv) processing the material through a bath having bleach-fixing capacity.

* * * * *